US007567146B2

(12) United States Patent
Tervo

(10) Patent No.: US 7,567,146 B2
(45) Date of Patent: Jul. 28, 2009

(54) DIRECTIONAL COUPLER

(75) Inventor: Matti Tervo, Oulu (FI)

(73) Assignee: Powerwave Comtek Oy, Kempele (FI)

( * ) Notice: Subject to any disclaimer, the term of this patent is extended or adjusted under 35 U.S.C. 154(b) by 0 days.

(21) Appl. No.: 12/198,170

(22) Filed: Aug. 26, 2008

(65) Prior Publication Data

US 2009/0045887 A1 Feb. 19, 2009

Related U.S. Application Data

(63) Continuation of application No. PCT/FI2007/050079, filed on Feb. 14, 2007.

(30) Foreign Application Priority Data

Feb. 28, 2006 (FI) ..... 20065144

(51) Int. Cl.
*H01P 5/18* (2006.01)
*H01P 3/06* (2006.01)

(52) U.S. Cl. ..... 333/112; 333/109

(58) Field of Classification Search ..... 333/109, 333/110, 111, 112, 115, 116, 117, 118, 123
See application file for complete search history.

(56) References Cited

U.S. PATENT DOCUMENTS

| | | | |
|---|---|---|---|
| 3,550,042 | A | 12/1970 | Werlau |
| 4,216,446 | A | 8/1980 | Iwer |
| 5,424,694 | A | 6/1995 | Maloratsky et al. |

FOREIGN PATENT DOCUMENTS

| | | |
|---|---|---|
| FI | 20040450 | 9/2005 |
| JP | 62159502 | 7/1987 |
| WO | 97/10622 | 3/1997 |
| WO | 2005/093896 | 10/2005 |

*Primary Examiner*—Dean O Takaoka
(74) *Attorney, Agent, or Firm*—Darby & Darby P.C.

(57) ABSTRACT

A directional coupler with two sensing conductors and a basic coupler and a supplementary coupler corresponding to them. The basic coupler is based on the coupling between a first sensing conductor (421) and the transmission conductor (410), and the supplementary coupler is based on the coupling between a second sensing conductor (422) and the transmission conductor. The sensing conductors are substantially shorter than a quarter wave, because of which the directivity of both the basic and the supplementary coupler is low. The other ends of the sensing conductors are connected to each other and further to the measurement port of the directional coupler. The coupling signals caused by a reverse signal in the connecting point of the sensing conductors are arranged equal by their absolute value but oppositely phased, in which case their sum signal in the measurement port is insignificantly small. For this purpose, for example, the transmission line formed by the first sensing conductor and the ground is terminated with a matching element at its opposite end, and the transmission line formed by the second sensing conductor and the ground is left open at its opposite end. The termination impedances can be adjustable and the directional coupler thus tunable. In this manner, the directivity of the total directional coupler is improved by means of the second sensing conductor. The directional coupler is small-sized, and good directivity is achieved in a very large frequency range.

12 Claims, 4 Drawing Sheets

DIRECTIONAL COUPLER

The invention relates to an implementation way of the directional coupler used in radio-frequency circuits.

BACKGROUND OF THE INVENTION

The directional coupler is an arrangement related to the transmission path of a radio-frequency electromagnetic field. It gives a measurement signal the level of which is proportional to the strength of a field propagating to a particular direction in the transmission path. In principle, a field propagating to the opposite direction in the transmission path does not affect the level of the measurement signal. The directional coupler has at least three ports: an input, an output and a measurement port. The energy of a signal incoming to the input port is led almost totally through the coupler to the output port, and a small part of this energy is transferred to the measurement port. The part of the directional coupler between the input and output ports is at the same time a part of the transmission path of a radio apparatus which continues, for example, to the antenna of a transmitter. Then, a measurement signal proportional to the actual strength of the field propagating towards the antenna is received from the measurement port, which signal can be used in the controlling purposes of the transmitter. The accuracy of the control is partly dependent on the quality of the directional coupler, that is, of how completely the effect of the field propagating in the opposite direction in relation to the field to be measured is eliminated.

In this description and claims, the "forward signal/field" means a signal/field propagating from the input port to the output port of the directional coupler and the "reverse signal/field" means the signal/field propagating from the output port to the input port of the directional coupler.

A directional coupler may be designed in several ways. Most of them are based on the utilisation of transmission lines of quarter-wave length. FIG. 1 shows an example of such known directional coupler. In it, the transmission path of the signal to be measured comprises the transmission conductor 110 which is a first conductor strip on the upper surface of a circuit board PCB, and the signal ground GND which consists of the conducting lower surface of the circuit board. The head end of the first conductor strip 110 together with a conductor pad connected to the signal ground constitute the input port P1 of the directional coupler. Correspondingly, the tail end of the first conductor strip together with the signal ground constitute the output port P2 of the directional coupler. Additionally, on the upper surface of the circuit board PCB, there is a second conductor strip 120 parallel to the first conductor strip, the length of which second conductor strip is a quarter of wavelength λ at the operating frequencies of the directional coupler. The distance between the conductor strips 110 and 120 is for example a tenth of their distance from the ground. The second conductor strip 120 continues at its ends away from the first conductor strip. The first extension 121 ends at the third port, or the measurement port P3. When the directional coupler is in use, a circuit has been coupled to the measurement port the impedance Z of which circuit is equal to the characteristic impedance $Z_0$ of the transmission lines formed by the conductor strips of the directional coupler together with the signal ground and the medium. The second extension 122 of the second conductor strip ends at the fourth port P4 which is also called the isolated port here. Thus the directional coupler of the example has four ports, as do also most other directional couplers.

The second conductor strip 120 acts as a sensing conductor: Because of the electromagnetic coupling between it and the first conductor strip, part of the energy fed to the input port transfers to the circuit of the second conductor strip, to the load impedances of the ports P3 and P4. When the frequency of the forward field is such that the λ/4 condition aforementioned and drawn in FIG. 1 is fulfilled, the energy transferring to the measurement port P3 is at its maximum, and the energy transferring to the isolated port P4 at its minimum. The latter energy is zero in an ideal coupler, because even and odd waveforms occurring in the coupler cancel out each other in the isolated-port end of the transmission line based on the second conductor strip 120. The directivity of the coupler is based on this fact. Namely, if a reverse field of equal frequency exists in the directional coupler, almost none of its energy is transferred to the measurement port P3 because of the symmetrical structure. The quality of directivity is expressed as the proportion of the signal level in the measurement port to the signal level of the isolated port. This is the same thing as the relation of the signal level caused by the forward field to the measurement port to the signal level caused by the reverse field in the measurement port, when these fields propagating to opposite directions are of equal frequency and strength.

FIG. 2 shows an example of the directivity and bandwidth of the directional coupler according to FIG. 1. The figure shows the curves of two transmission coefficients as the function of frequency. Curve 201 shows the variation of the signal level in the measurement port in proportion to the level of the input signal, and curve 202 shows the variation of the signal level in the isolated port in proportion to the level of the input signal. The difference of coefficients expressed in decibels indicates the value of directivity. It appears from the curves that the directivity is at its highest about 20 dB which value is only valid in a frequency range the relative width of which is only a few percentages on both sides of the frequency 2.08 GHz corresponding the quarter wave. Directivity exceeds the value of 10 dB in the range of 1.8-2.45 GHz, the relative width of which is about 30%. Curve 201 also indicates that, in the operating range of the directional coupler, the signal level in the measurement port is about 25 dB lower than the signal level passing through the coupler. This means that the coupler causes a 0.014 dB attenuation to the passing signal.

If the directional coupler is used at a frequency in which the length of the parallel parts of conductor strips 110 and 120 corresponds a half wavelength, the situation in the third and the fourth port is reversed: the energy transferring to the third port P3 is at its minimum, and the energy transferring to the fourth port P4 is at its maximum. If the directional coupler then is used at frequencies which are low compared to the frequency corresponding the length of the quarter wave, directivity is very low.

The aforementioned value of directivity, 20 dB, typical in directional couplers according to FIG. 1, is still unsatisfactory. This relatively modest value is caused by the even and the odd waveform not totally cancelling out each other on the side of the isolated port, because the odd waveform also propagates in addition to dielectric medium at a greater amount in air, in which case its velocity is greater. A better structure by its directivity is achieved if both the conductor of the transmission path and the sensing conductor are arranged inside a dielectric board on both sides of which there is a ground plane. Directivity will also be improved when using a totally air-insulated transmission line. However, a further disadvantage of all directional couplers using lines of λ/4 length is that they function satisfactorily only in a relatively narrow frequency range and that they require a relatively large space.

SUMMARY OF THE INVENTION

The object of the invention is to minimize the disadvantages of the prior art. The directional coupler according to the invention has an input port (P1), an output port (P2) and a measurement port (P3). The coupler also has a transmission path made up with a transmission conductor, a signal ground (GND) and interspace or dielectric space between them. The transmission path leads a signal to be measured from the input port to the output port. A first sensing conductor located in the interspace parallel to the transmission conductor forms a coupling signal in proportion to the strength of a signal (Sff) propagating on the transmission path. The head end of the first sensing conductor is coupled to the measurement port of the directional coupler. The directional coupler is characterized in that in the interspace of the transmission path there is a second sensing conductor parallel to the transmission conductor, and both the first and the second sensing conductors are substantially shorter than a quarter wave of an operating frequency of the coupler. The head ends of the sensing conductors are connected to each other and to the measurement port by a measurement conductor. The sensing conductors are coupled from their tail ends to the signal ground and are designed and located so that coupling signals caused by a reverse signal (Srev) are substantially equal of their level and oppositely phased at the connecting point of the sensing conductors in order to cancel them out. There are several advantageous embodiments of the invention.

The basic idea of the invention is the following: The directional coupler comprises two sensing conductors and, correspondingly, two sides: a basic coupler and a supplementary coupler. The basic coupler is based on the coupling between the first sensing conductor and the transmission conductor, and the supplementary coupler is based on the coupling between the second sensing conductor and the transmission conductor. The sensing conductors are substantially shorter than a quarter wave, because of which the directivity of both couplers is low. The other ends of two sensing conductors are connected to each other and further to the measurement port of the directional coupler. The coupling signals caused by a reverse signal in the connecting point of the sensing conductors are arranged equal by their absolute value but oppositely phased, in which case their sum signal in the measurement port is insignificantly small. This will be realised when the transmission line formed by the first sensing conductor and the ground is terminated by a matching element at its opposite end, and the transmission line formed by the second sensing conductor and the ground is left at least almost open at its opposite end. For making the cancelling out of said coupling signals more accurate, the directional coupler can be tunable so that the impedance of the matching element is adjustable or there is a tuning element in the end of the line corresponding to the second sensing conductor. In this way the directivity of the whole directional coupler is improved by means of the second sensing conductor. The coupling signals caused by the forward signal are not cancelled out in the connecting point of the sensing conductors, because their phase difference is not great, and the signal of the basic coupler is stronger.

An advantage of the invention is that the directional coupler according to it is small-sized. An additional advantage of the invention is that the frequency dependency of the directional coupler according to it is small: High directivity is achieved and the level of the measurement signal in proportion to the level of the signal to be measured is relatively constant in a very large frequency range. Also the return loss of the input port of the directional coupler is low in a very large frequency range. A further advantage of the invention is that the tuning of the directional coupler according to it is simple in production and incurs relatively low costs.

BRIEF DESCRIPTION OF THE DRAWINGS

The invention will now be described in detail. The description refers to the accompanying drawings in which.

DETAILED DESCRIPTION OF THE INVENTION

Figure 1:
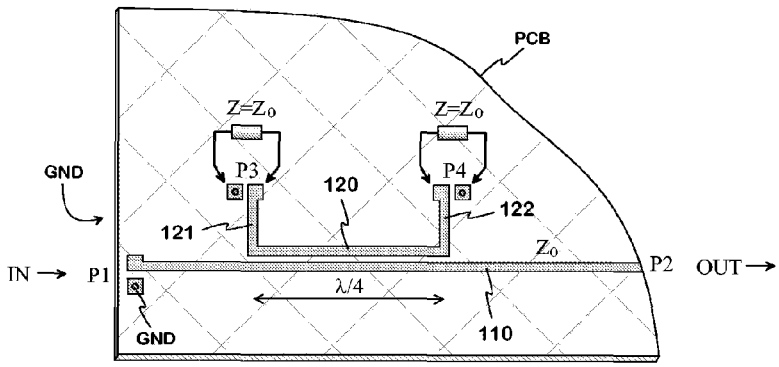
Fig. 1 PRIOR ART
FIG. 1 shows an example of a directional coupler according to prior art.
Figure 2:
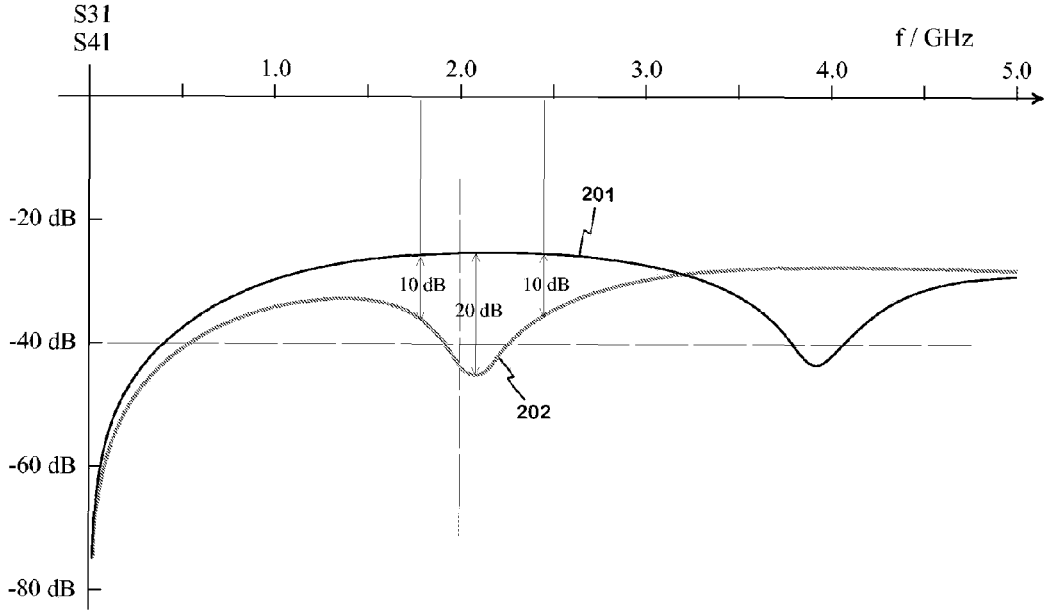
Fig. 2 PRIOR ART
FIG. 2 shows an example of the characteristics of a directional coupler according to prior art.

FIGS. 1 and 2 were already described in connection with the description of prior art.

Figure 3:
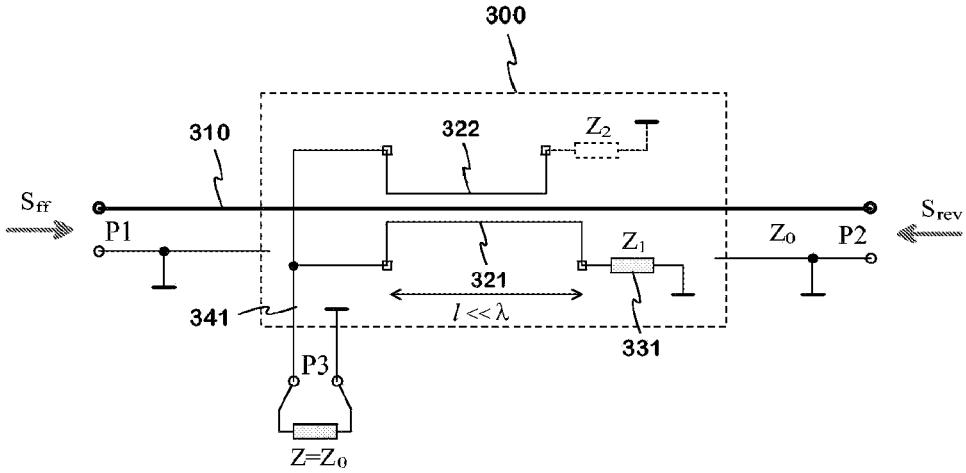
FIG. 3 shows the principle of the structure of the directional coupler according to the invention.

FIG. 3 is a presentation of the principles of the directional coupler according to the invention. The directional coupler 300 comprises a transmission path including a transmission conductor 310, a ground conductor, or a signal ground GND and their dielectric interspace. In this description and claims, the "interspace" means a space, where the electromagnetic field of a signal propagating on the transmission path significantly exists. The characteristic impedance of the transmission path is $Z_0$. The end of the transmission path through which the forward signal $S_{ff}$ to be measured arrives at the directional coupler is its input port P1, and the other end of the transmission path through which the signal to be measured exits the directional coupler is its output port P2.

In addition, the directional coupler 300 also comprises, according to the invention, a first 321 and a second 322 sensing conductor which are located in the interspace of the transmission path and are parallel to the transmission conductor. Thus, the directional coupler has two sides: a basic coupler and a supplementary coupler. The basic coupler is based on the coupling between the first sensing conductor 321 and the transmission conductor 310, and the supplementary coupler is based on the coupling between the second sensing conductor 322 and the transmission conductor. The head ends of the sensing conductors, or the ends closer to the input port are galvanically coupled to each other and further to the measurement port P3 of the directional coupler by a measurement conductor 341. The measurement conductor forms with the signal ground a transmission line the characteristic impedance of which is for example the same $Z_0$ as the one of the transmission path. In that case also the impedance of an external circuit coupled to the measurement port has to be $Z_0$. Because of connecting the head ends of the sensing conductors, the coupling signal to the transmission line formed by the first sensing conductor and the signal ground and the coupling signal to the transmission line formed by the second sensing conductor and the signal ground caused by a signal propagating in either direction are summed in the connecting point of these lines and thus in the measurement port. Let us denote:

$C_{11}$=the coupling signal caused by a forward signal $S_{ff}$ in the head end of the transmission line formed by the first sensing conductor and the signal ground $C_{12}$=the coupling signal caused by a forward signal $S_{ff}$ in the head end of the transmission line formed by the second sensing conductor and the signal ground $C_{21}$=the coupling signal caused by a reverse signal $S_{rev}$ in the head end of the transmission line formed by the first sensing conductor and the signal ground $C_{22}$=the coupling signal caused by a reverse signal $S_{rev}$ in the head end of the transmission line formed by the second sensing conductor and the signal ground.

Both sensing conductors are substantially shorter than a quarter wave corresponding to the using frequency, their length is, for example, of order of a twentieth of wavelength λ. The sensing conductors may be of different lengths; in the example of FIG. 3, the second sensing conductor is shorter. Because of the shortness of the sensing conductors, the directivity of both the basic and the supplementary coupler is low. Therefore, the reverse signal $S_{rev}$ arriving at the output port P2 from outside causes a relatively strong coupling signal to the head end of the line corresponding both the first and the second sensing conductor. In the directional coupler according to the invention, these coupling signals $C_{21}$ and $C_{22}$ are of equal level but oppositely phased. Thus the total coupling signal in the measurement port, caused by the reverse signal $S_{rev}$, is insignificantly small, from which follows that the directivity of the whole directional coupler becomes high. The coupling signals $C_{21}$ and $C_{22}$ are arranged to be of equal level by dimensioning and locating the sensing conductors appropriately. The phases again are made approximately opposite by matching the transmission line formed by the first sensing conductor 321 and the ground with a matching element 331 at its tail end and by leaving the transmission line formed by the second sensing conductor and the ground open at its tail end. The impedance $Z_1$ of the matching element is typically purely resistive. Additionally, it may have a capacitive part for tuning the directional coupler, i.e., for ensuring said oppositely phasing. Alternatively, the tuning of the directional coupler may be implemented by a tuning element to be placed in the tail end of the transmission line formed by the second sensing conductor 322 and the ground which element can be adjustable. In FIG. 3 such a tuning element has been drawn in dashed line, and its impedance is marked with $Z_2$. This impedance is, for example, capacitive and high of its absolute value. The terminating way of the transmission lines corresponding to the sensing conductors affects in addition to the phases of the coupling signals also naturally their levels.

Also the coupling signals $C_{11}$ and $C_{12}$ caused by the forward signal $S_{ff}$ are summed in the connecting point of lines corresponding the sensing conductors. In this case, the coupling signals do not cancel out each other, because their phase difference is not great, and the coupling signal $C_{12}$ is smaller of its level than the coupling signal $C_{11}$. The latter fact is caused by that the sensing conductors are further arranged so that the directivity of the supplementary coupler is even smaller than the directivity of the basic coupler, i.e., $C_{11}-C_{21}>C_{12}-C_{22}$. As $C_{21}=C_{22}$, then $C_{11}>C_{12}$. Thus only the forward signal $S_{ff}$ causes a measurable total coupling signal to the measurement port as the matter also has to be.

Figure 4A:
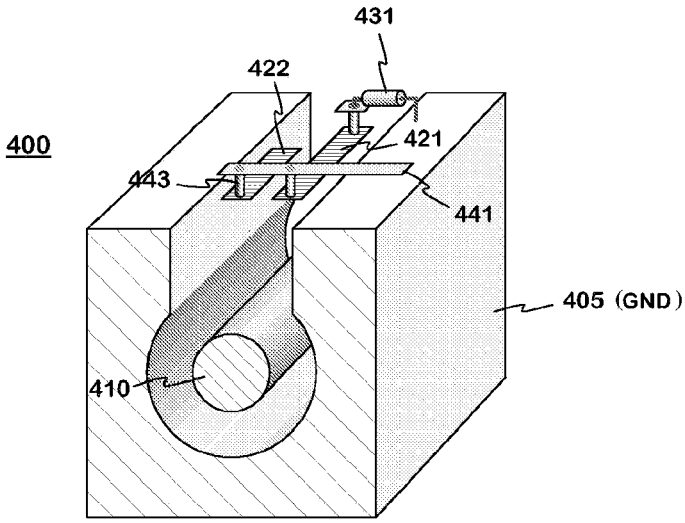
FIGS. 4*a-c* show an example of a practical directional coupler according to the invention.
Figure 4B:
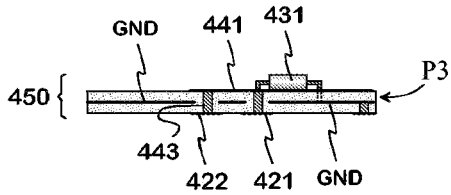
Figure 4C:
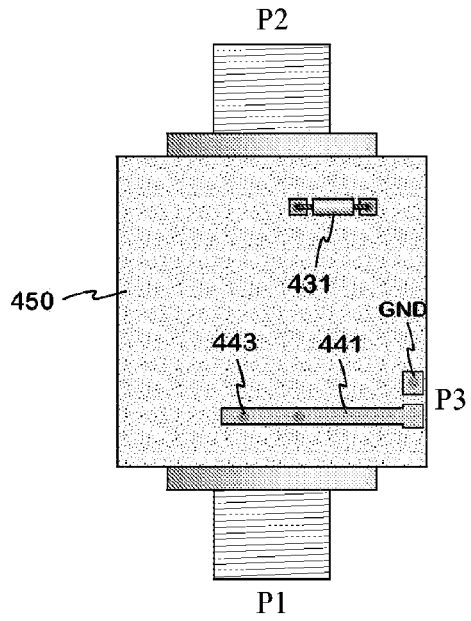

FIGS. 4*a-c* show an example of a practical directional coupler according to the invention. FIG. 4*a* is a perspective drawing of a directional coupler 400 stripped down so that its most substantial conducting parts are visible. The transmission path of the directional coupler is coaxial comprising a transmission conductor 410 which in this case is the middle conductor, and a relatively massive outer conductor 405 which is part of the signal ground GND. The outer conductor surrounds the middle conductor excluding an opening in it, parallel to the middle conductor. The sensing conductors 421, 422 of the directional coupler are located at this opening on level with the outer surface of the outer conductor. They are conductor strips parallel to the middle conductor 410 on the lower surface of a small dielectric board, not seen in FIG. 4*a*, covering the opening of the outer conductor, that is, on the surface on the side of the cavity of the transmission path. Hence, the sensing conductors are in the interspace of the transmission path and thus in the electromagnetic field of the signal propagating in the transmission path. On the upper surface of said board, there is a measurement conductor 441 perpendicular to the sensing conductors, from which measurement conductor there is a via 443 to the head end of the second sensing conductor 422. There is also a similar via from the measurement conductor to the head end of the first sensing conductor. Above the board there is a matching element 431 one end of which is connected through a via to the tail end of the first sensing conductor and the other end to the signal ground.

FIG. 4*b* shows a small circuit board 450 pertaining to the directional coupler 400. The aforementioned dielectric board is the dielectric support part of this circuit board. The circuit board is shown as a cross section at the vias 443 connecting the measurement conductor 441 to the sensing conductors 421, 422. In this example, the circuit board 450 has two dielectric layers between which there is the ground plane GND of the size of the board. This ground plane forms the second conductor of the transmission lines corresponding to the sensing conductors and the measurement conductor. On the other hand, the ground plane electrically closes the opening in the outer conductor of the transmission path so that the field stays in the cavity of the transmission path. The other end of the adjusting element 431 is connected through its own via to the ground plane. The measurement port P3 of the directional coupler consists of the outer end of the measurement conductor 441 and the ground plane at it.

FIG. 4*c* shows the directional coupler 400 seen from the side of the circuit board 450. On the upper surface of the circuit board, the measurement conductor 441 and the adjusting element 431 are visible. Also drawn in FIG. 4*c* are connectors forming the input port P1 and the output port P2 of the directional coupler which connectors are fastened to the planar end surfaces of the outer conductor of the directional coupler.

The measurement conductor of the directional coupler could also travel, for example, on the lower surface of the circuit board perpendicular to the sensing conductors, in which case no vias for the sensing conductors are required. The ground plane could in that case be located on the upper surface of the circuit board.

The adjusting element 431 can be for example a fixed resistor or a pin diode. In the latter case its resistance can be adjusted with a separate control voltage for tuning the directional coupler. The adjusting of the resistance can naturally be implemented by a trimmer potentiometer, too. The tuning can also be implemented, for example, by a capacitive part parallel with the adjusting resistor. This can be fixed or a trimmer capacitor or a capacitance diode.

Figure 5:
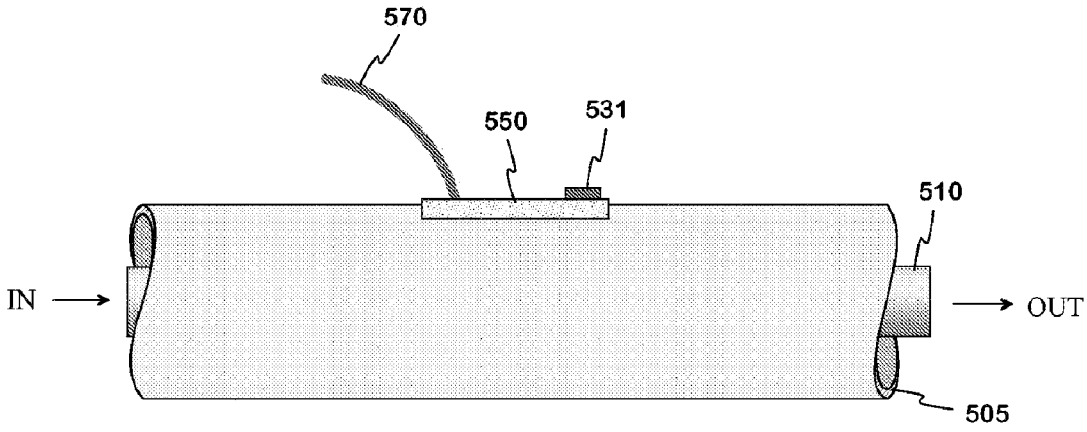
FIG. 5 shows a second example of a directional coupler according to the invention.

FIG. 5 shows a second example of a practical directional coupler according to the invention. This has been constituted by fastening a circuit board 550 similar to the circuit board shown in FIGS. 4*a-c* to an opening made in the outer conductor 505 of the coaxial cable. The part of the coaxial cable at the circuit board 550 acts as the trans-mission path of the directional coupler. Also drawn in FIG. 5 is the measurement line 570 starting from the measurement port of the directional coupler.

Figure 6:
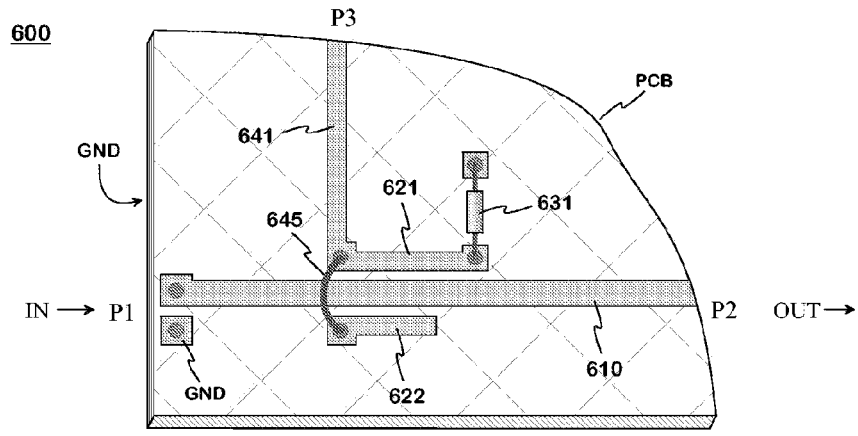
FIG. 6 shows a third example of a directional coupler according to the invention.

FIG. 6 shows a third example of a practical directional coupler according to the invention practice. The transmission path of the signal to be measured comprises a conductor strip 610 on the upper surface of the circuit board PCB of a device and the ground plane on the lower surface of the circuit board similarly to the known structure shown in FIG. 1. The first sensing conductor 621 is beside the conductor strip 610, or the transmission conductor, and the second sensing conductor 622 is at the same point on the other side of the transmission conductor. The head ends of the sensing conductors are connected to each other over the transmission conductor by a jumper wire 645. The measurement conductor 641 is for its other parts physically the same conductor strip with the first sensing conductor 621 starting from the head end of this perpendicularly away from the transmission conductor. Also in this example, the matching element 631 is connected between the tail end of the first sensing conductor and the signal ground.

The circuit board, in which the transmission path passes, can naturally be a multilayer circuit board, too. In this case the transmission conductor strip as well as the sensing conductor and measurement conductor strips are advantageously inside the circuit board between two ground planes. Also the conductor connecting the head ends of the sensing conductors can be in some intermediate layer. The transmission conductor and the sensing conductors may be parallel as in FIG. 6 or superposed in different layers of the circuit board.

Figure 7:
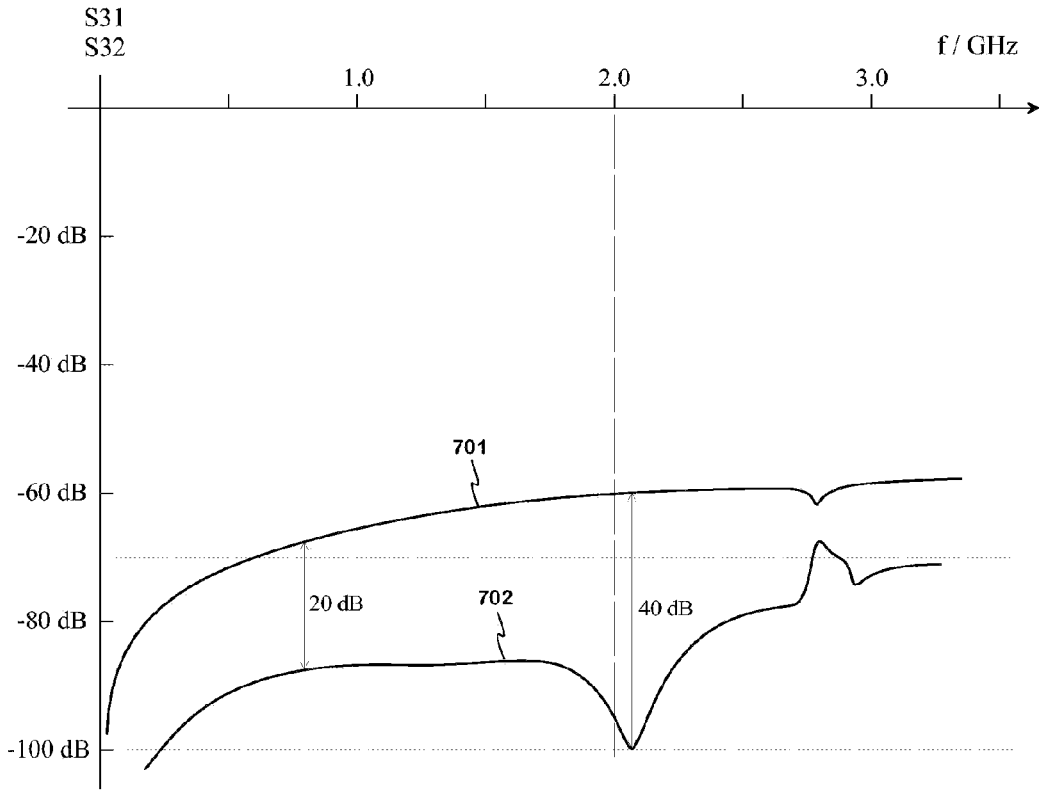
FIG. 7 shows an example of the characteristics of a directional coupler according to the invention.

FIG. 7 shows an example of the characteristics of a directional coupler according to the invention. Curve 701 shows the variation of the signal level in the measurement port in proportion to the level of the forward signal, and curve 702 shows the variation of the signal level in the measurement port in proportion to the level of the reverse signal of equal level. The curves are measured from a directional coupler according to FIGS. 4*a-c* in which the diameter of the inner conductor is 7 mm and the inner diameter of the outer conductor is 16 mm. The length of the first sensing conductor is about 5 mm and the one of the second about 3 mm. The distance of the sensing conductors is 1 mm and their distance from the transmission conductor is 10 mm. The directional coupler is tuned to its optimum by a trimmer potentiometer. Curve 701 corresponds to curve 201 in FIG. 2, and curve 702 to curve 202 in FIG. 2. Thus, the difference of coefficients expressed in decibels indicates the value of the directivity. It appears from the curves that the directivity is good in a very large frequency range. The improvement compared to the prior art shown in FIG. 2 is very notable. The directivity of the directional coupler according to the invention exceeds the value of 20 dB in the range of about 0.8-2.5 GHz. For example in the range of 1.9-2.2 GHz the directivity is 30 dB or better.

The return loss in the input port of the directional couplers according to the invention is in practice independent of frequency, contrary to known directional couplers. In the coupler of the example, from which the curves of FIG. 7 are measured, return loss is about 15 dB.

In this description and claims, prefixes "lower" and "upper" are used only for illustrative purposes. They have nothing to do with the operating position of the directional coupler.

Above are described directional coupler structures according to the invention. Their implementation way can differ in their details from the ones described. The transmission path of the directional coupler can be of any type of the known transmission line structures. The inventive idea may be applied in different ways within the scope set by the independent claim 1.

The invention claimed is:

1. A directional coupler comprising an input port, an output port, a measurement port, a transmission path with a transmission conductor, a signal ground and their interspace to lead a signal to be measured from the input port to the output port and a first sensing conductor being located in the interspace parallel to the trans-mission conductor for forming a coupling signal in proportion to the strength of a signal propagating on the transmission path, the head end of which first sensing conductor is coupled to the measurement port of the directional coupler, wherein in the interspace of the transmission path there is further a second sensing conductor parallel to the transmission conductor both the first and the second sensing conductor are substantially shorter than a quarter wave corresponding to an operating frequency the head ends of the sensing conductors are connected to each other and to the measurement port by a measurement conductor, and the sensing conductors are coupled from their tail ends to the signal ground and designed and located so that coupling signals caused by a reverse signal are substantially equal of their level and oppositely phased in connecting point of the sensing conductors to cancel them out.

2. A directional coupler according to claim 1 comprising a basic coupler based on the coupling between the first sensing conductor and the transmission conductor and a supplementary coupler based on the coupling between the second sensing conductor and the transmission conductor, wherein the directivity of the supplementary coupler is substantially lower than the directivity of the basic coupler.

3. A directional coupler according to claim 1, the transmission path of which being coaxial, and there is an opening in the outer conductor of the coaxial transmission path in the direction of the transmission conductor, to locate said sensing conductors to said interspace.

4. A directional coupler according to claim 3 comprising a circuit board, which covers said opening and comprises a ground plane connected to the signal ground, the first and the second sensing conductor being conductor strips on lower surface of the circuit board and the measurement conductor being a conductor strip of the circuit board substantially perpendicular to the sensing conductors, and there is a tuning element on the side of upper surface of the circuit board fastened to it.

5. A directional coupler according to claim 1, the transmission path of which consists of at least one ground plane and a conductor strip functioning as the transmission conductor belonging to a circuit board of a device, wherein the first and the second sensing conductor and the measurement conductor are conductor strips belonging to said circuit board.

6. A directional coupler according to claim 5, wherein the ground plane is on lower surface of said circuit board, the transmission conductor and said sensing conductors are on upper surface of the circuit board, the first sensing conductor is on one side of the transmission conductor and the second sensing conductor on the other side of the transmission conductor.

7. A directional coupler according to claim 5, wherein said circuit board is a multi-layer board with two ground planes, and the transmission conductor and the sensing conductors are between these ground planes in parallel or one upon the other.

8. A directional coupler according to claim 1, wherein the first sensing conductor is coupled from its tail end to the signal ground by a substantially resistive matching element, and the second sensing conductor is coupled from its tail end to the signal ground by a relatively high impedance as a part of said arranging the coupling signals caused by the reverse signal oppositely phased in the connecting point of the sensing conductors.

9. A directional coupler according to claim 8, said matching element being a fixed resistor, a trimmer potentiometer or a pin diode.

10. A directional coupler according to claim 8, said matching element comprising a resistor and an adjustable capacitive part which is a capacitance diode or a trimmer capacitor.

11. A directional coupler according to claim 8, said relatively high impedance meaning an open tail end of the transmission line.

12. A directional coupler according to claim 11, said relatively high impedance being formed by a fixed or an adjustable capacitor having a small capacitance.

* * * * *